United States Patent [19]

Clement

[11] Patent Number: 4,587,677

[45] Date of Patent: May 13, 1986

[54] HELMET FACE MASK

[75] Inventor: Leonard W. H. Clement, Bolton, Canada

[73] Assignee: Cooper Canada Limited, Toronto, Canada

[21] Appl. No.: 662,991

[22] Filed: Oct. 16, 1984

[51] Int. Cl.[4] ..... A63B 71/10; A42B 1/08

[52] U.S. Cl. ..... 2/424; 24/458; 24/625

[58] Field of Search ..... 24/458, 489, 492, 625; 2/424, 425, 9, 6

[56] References Cited

U.S. PATENT DOCUMENTS

| | | | |
|---|---|---|---|
| 2,096,319 | 10/1937 | Churchill | 24/625 X |
| 2,267,558 | 12/1941 | Fernberg | 24/625 X |
| 3,113,318 | 12/1963 | Marietta | 2/9 |
| 3,167,783 | 2/1965 | Wolfe | 2/9 |
| 3,345,706 | 10/1967 | Stokes | 24/458 X |
| 3,658,054 | 4/1972 | Iberall | 2/9 |
| 4,370,759 | 2/1983 | Zide | 2/424 |

FOREIGN PATENT DOCUMENTS

| | | | |
|---|---|---|---|
| 1116801 | 1/1982 | Canada | 2/425 |
| 3025770 | 2/1982 | Fed. Rep. of Germany | 2/425 |
| 1111742 | 3/1956 | France | 24/625 |
| 540395 | 10/1941 | United Kingdom | 24/625 |

*Primary Examiner*—Werner H. Schroeder
*Assistant Examiner*—Andrew M. Falik
*Attorney, Agent, or Firm*—Sim & McBurney

[57] ABSTRACT

A clip joins a face mask to a helmet, the helmet having an elongate element like a wire and the face mask having a recess in the form of an elongate slot. The clip has two similar halves integrally pivoted together and defining adjacent the pivot region a receiving cavity for the elongate element. Each half of the clip is adapted to co-act resiliently with the recess to be retained by and in it.

7 Claims, 6 Drawing Figures

HELMET FACE MASK

This invention relates generally to protective helmets of the kind used in sports such as hockey, and has to do particularly with the construction of a face mask unit for use with such a helmet, the face mask unit employing certain features of quick-release and adjustability which give it useful advantages over prior art constructions.

BACKGROUND OF THIS INVENTION

Many helmets of the kind here contemplated are designed to be used in conjunction with a face mask. In some areas, it is mandatory for hockey players, for example, to utilize not only helmets but protective face masks attached to the helmets.

The prior art is notable for its lack of face mask constructions in which ready adjustability and a quick-release function are provided. In many cases, the face masks are of a single size, corresponding to the helmet size, and players whose facial measurements are larger than average, particularly in the lower jaw, find difficulty and discomfort in wearing these "average" sized helmet and mask combinations.

A further lack in the prior art is the provision of a hinge-type connection between the face mask and the helmet which is not only secure and resistant to dislodgement, but which is easily applied in assembling the mask to the helmet.

GENERAL DESCRIPTION OF THIS INVENTION

In view of the above-described shortcomings of the prior art, it is an aspect of this invention to provide a face mask construction for a helmet in which the mask itself is easily adjustable without requiring tools and without needing to remove the helmet, in which the mask can be easily and quickly swung out away from the face, and in which the mask can be readily assembled to the helmet to provide a sturdy, reliable and freely-swingable pivotal joint.

The latter feature is the focus of the simplest formulation of this invention, which provides a clip for joining a first member to a second, the first member having an elongate element and the second member having a recess in the form of an elongate slot. The clip comprises two similar halves integrally pivoted together and defining adjacent the pivot region a receiving cavity for the elongate element, each half having resilient means adapted to co-act with the recess to be retained by and in the recess.

GENERAL DESCRIPTION OF THE DRAWINGS

One embodiment of this invention is illustrated in the accompany drawings, in which like numerals denote like parts throughout the several views, and in which:

FIG. 1 is an elevational view of a helmet and face mask combination showing the face mask in its normal position and adjusted to its smallest size;

FIG. 1*a* is a partial view similar to FIG. 1, showing the face mask in solid lines adjusted outwardly to a larger position with respect to the helmet, and showing intermediate positions in broken lines;

DETAILED DESCRIPTION OF THE DRAWINGS

Figures 1, 1A:
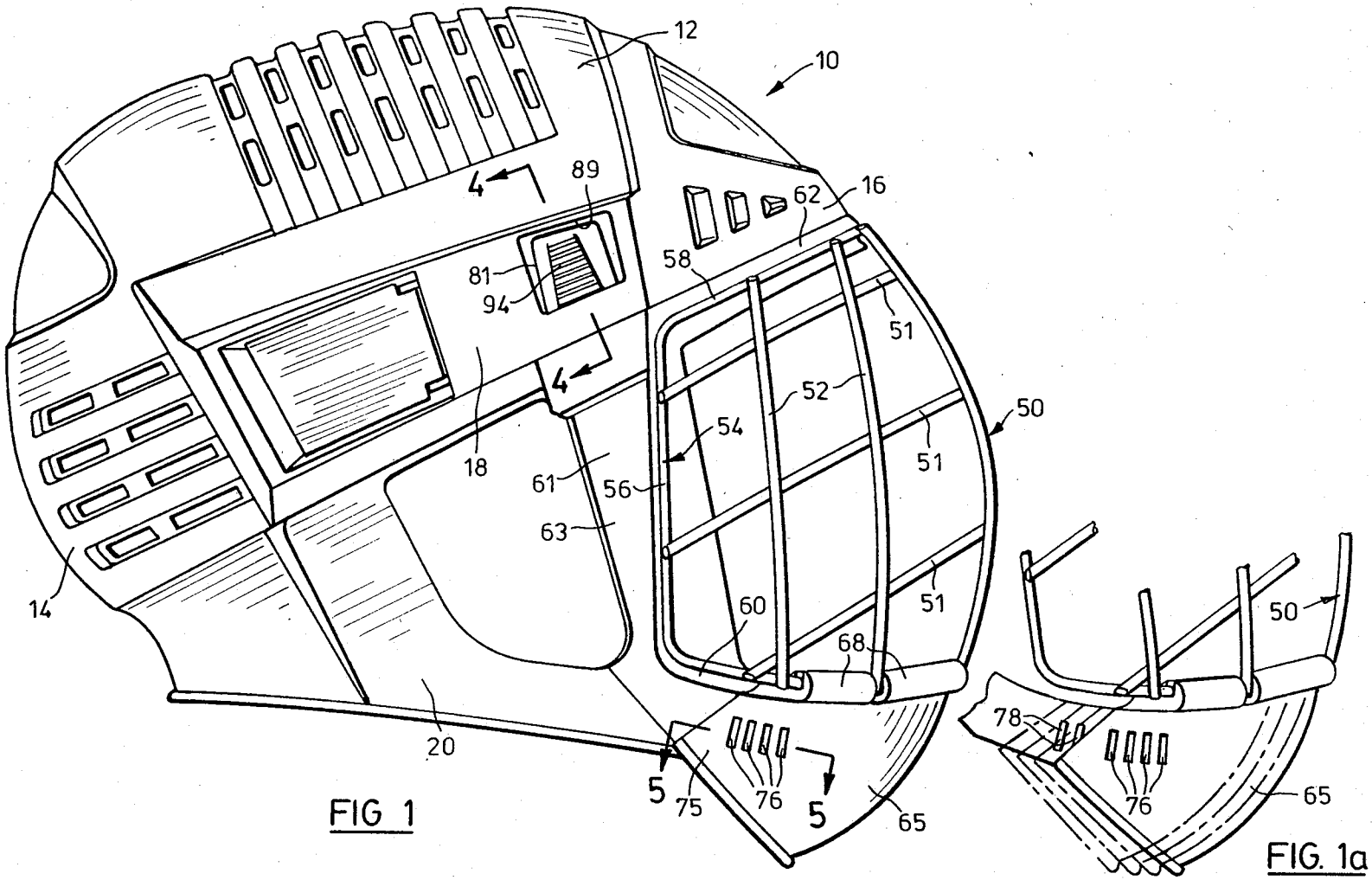

Attention is first directed to FIG. 1, which shows a helmet at 10 which includes a top portion 12, a rear portion 14, a forehead portion 16 and a temple portion 18. An additional structure 20 extends down from the temple portion 18 in order to protect the ear of the wearer. The forward edge of the structure 20 is shown at 22 in FIG. 3.

Figure 3:
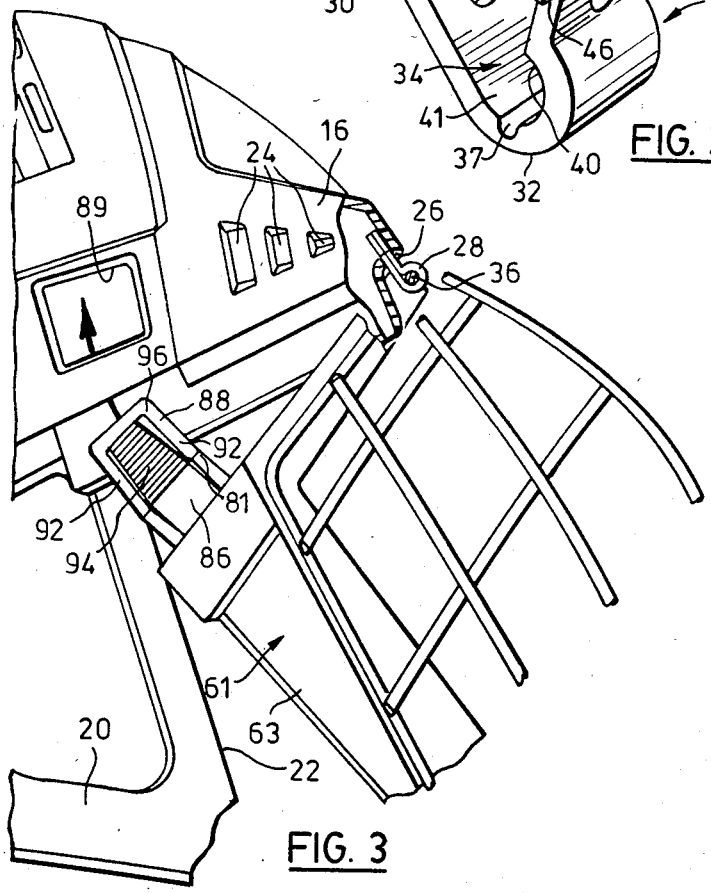
FIG. 3 is a partial view, partly broken-away and similar to FIG 1, showing the face mask in an outwardly pivoted position.

As seen in FIG. 3, the forehead portion 16, which includes vent holes 24 in accordance with standard practice, has at its central, forward region a structure which defines a slot 26, which is elongated in the direction at right angles to the page in FIG. 3, i.e. parallel with the forward surface of the forehead portion 16.

A clip 28, shown to a larger scale in FIG. 3, is intended to join the face mask to the helmet. FIG. 3 further shows portions of the face mask with which the clip 28 interacts.

Figure 2:
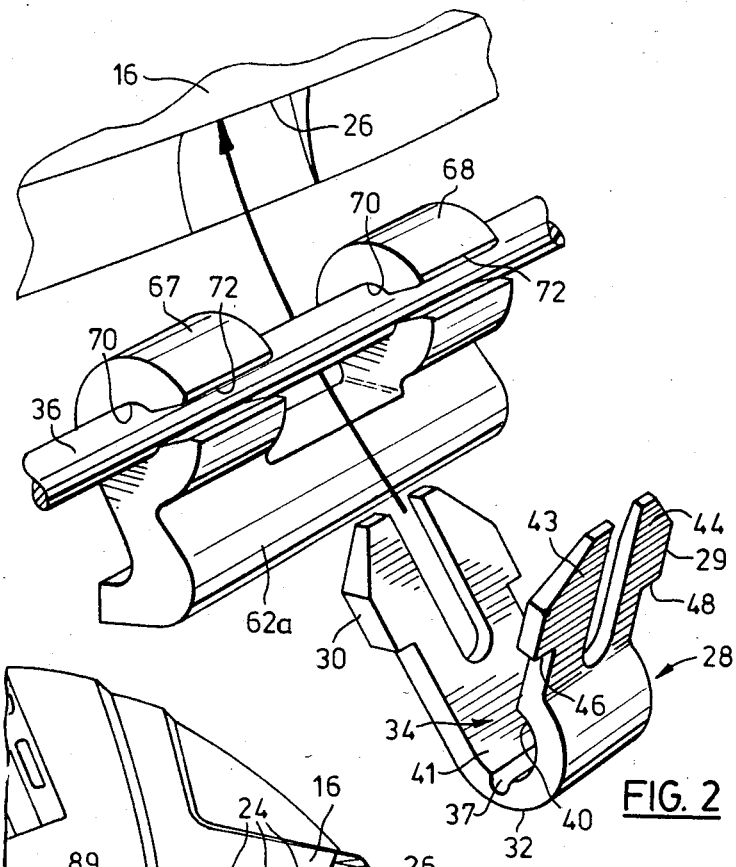
FIG. 2 is a view, to a larger scale, of two co-acting components of the structure shown in FIG. 1.

More specifically, turning to FIG. 2, it is seen that the clip 28 includes two similar halves 29 and 30 which are integrally pivoted together at the region 32 and define adjacent the pivot region a receiving cavity 34 for an elongate element which is shown in FIG. 2 as a wire 36. The wire 36 is an integral part of the wire grid of the face mask, as will be described subsequently.

It will be noted in FIG. 2 that, in the region 32 of the clip 28, the material of the clip 28 is reduced in thickness by a groove 37, thus allowing the two halves 29 and 30 to pivot easily with respect to each other. It will also be seen in FIG. 2 that the half 29 is shaped somewhat like a question mark in section, to define a semi-cylindrical recess 40, whereas the half 30 simply defines a gentle curving portion 41 adjacent the recess 40. However, the recess 40 and the portion 41 together make up the receiving cavity 34, and the particular shape of the half 29 is adapted to retain the wire 36 within the cavity 34.

Each of the halves 29 and 30 include resilient means adapted to co-act with the slot 26 so that they will be retained by and in the slot. More particularly, each half 29 and 30 is bifurcated to define two resilient tines. Looking at FIG. 2, the half 29 is bifucated into resilient tines 43 and 44, each of which has an external step 46 and 48 adapted to engage a shoulder region within the slot 26, so that the clip is retained within the slot 26. The shoulder regions of the slot 26 lie to either side of the plane of the drawing in FIG. 3, as the drawing is assumed to pass centrally through the clip 28.

Attention is now briefly directed to FIGS. 1 and 2, for a general description of the face mask. As seen, the face mask includes a wire grid 50 which includes horizontal wires 51, upright wires 52, and a peripheral wire 54 which has side portions 56, a top portion 58, and a curvilinear bottom portion 60. The wire 36 shown in FIG. 2 is an integral part of the top portion 58 of the peripheral wire 54.

The face mask also includes a frame 61 which lies generally adjacent the peripheral wire 54 of the wire grid 50, and includes a top portion 62 and two side portions 63, all integral with each other, as well as a movable bottom portion 65 in the shape of a curvate chin-protector. The bottom portion 65 is connected to the curvilinear bottom portion 60 of the peripheral wire 54, by virtue of integral, rounded sleeves 68 through which the bottom portion 60 of the wire passes.

Before describing the adjustability of the bottom portion 65 with respect to the side portions 63, it is desirable to turn once more to FIG. 2, and to explain the way in which the wire 36 (forming a part of the top portion 58 of the peripheral wire 54) is secured with respect to the face mask frame. In FIG. 2, part of the top portion 62 of the face mask frame is shown at 62*a*, and is seen to define two integral, resilient, upstanding, spaced-apart brackets 67 and 68, which define lateral slots 70 into which the wire 36 can snap to extend between the brackets 67 and 68. More particularly, the slots 70 have narrow entry portions 72, to allow the wire to snap inwardly and be retained in the slots 70. By virtue of the brackets 67 and 68, the wire grid 50 is securely and pivotally mounted with respect to the face mask frame to the extent of the top portion 62 and the two side portions 63. The function of the clip 28, which receives in the cavity 34 that portion of the wire 36 lying between the brackets 67 and 68, is to allow a secure but pivotal connection between three independently swingable elements: the helmet 10, the wire grid 50, and the face mask frame 61.

As previously mentioned, an adjustment means is provided between the wire grid 50 and the face mask frame 63, so that the wire grid 50 can assume and be fixed in any one of a plurality of angulated positions with respect to the frame 61. Specifically, the lower portion 65 of the frame 61 is part of the adjustment means, and to this end has side portions 75 which overlap the side portions 63 of the frame 61 on the outside thereof, and have an irregular structure for registering with complementary structure on the respective side portions 63 of the frame 61.

Figure 5:
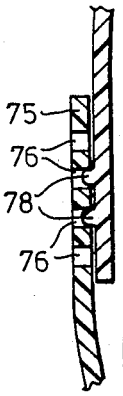
FIG. 5 is a sectional view taken at the line 5—5 in FIG. 1.

Still more particularly, and with reference to FIGS. 1, 1*a* and 5, the irregular structure on the side portions 75 include a plurality of openings 76 which are aligned along an arc having its centre of curvature at the axis of the wire 36 (FIG. 2). The complementary structure on the side portions 63 of the frame 61 include at least one and preferably a plurality of protuberances 78 adapted to register in one or more of the plurality of openings 76.

FIG. 1*a* shows that it is possible to move the portion 65 downwardly and forwardly by pivoting about the wire 36 (which is a portion of the peripheral wire 54 of the wire grid). It is merely a matter of using sufficient force in the downward and forward pull to shift the registration of the protuberance or protuberances 78 and the openings 76. Once set in the new position, the portion 65 and the wire grid 50 will remain in that position with respect to the frame 61.

Figure 4:
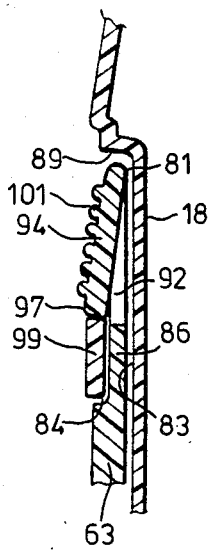
FIG. 4 is a sectional view taken at the line 4—4 in FIG. 1.

The frame 61 has two further elements remote from the brackets 67 and 68, for releasably engaging the frame 61 with the helmet 10, thereby to retain the frame 61 in a given position with respect to the helmet 10. More specifically, and with reference to FIGS. 1, 3 and 4, there is provided, integral with the frame 61, two upstanding tabs 81, one at either side at the tops of the respective side portions 63. As best seen in FIGS. 3 and 4, the temple portion 18 of the helmet 10 defines a vertical slot 83 which is open at the bottom 84, and is capable of receiving the tab 81. The latter has a neck portion 86, and a head portion 88 which is adapted to be received snugly but slidably up into the slot 83. At the upper portion of the slot 83, a window 89 is removed, so that the head 88 can be pushed far enough upwardly to register directly within the window 89. The head 88 is formed with two side portions 92, between which is integrally provided a tongue portion 94 connected to the side portions 92 only at the upper, outer corners 96. When moulded, the tongue portion 94 is angulated with respect to the side portions 92, and always seek an "at rest" position which is that shown in FIG. 4, namely one in which the tongue portion 94 has its bottom end 97 sidewardly displaced from the plane containing the side portions 92.

It will now be evident that, as the tab 81 is initially inserted into and thrust upwardly along the slot 83, the tongue portion 94 will be urged inwardly to a position of alignment with the side portions 92 of the head 88. However, as soon as the bottom 97 of the tongue portion 94 rises to a point where it is even with the bottom of the window 89, and thus no longer constrained, the tongue portion 94 will move to its unstressed position, which is that shown in FIG. 4, and which provides mechanical interference between the bottom 97 of the tongue portion 94 and the outer wall 99 of the slot 83, the outer wall 99 being continuous with the rest of the surface at the temple portion 18 of the helmet 10.

In order to release the tabs 81 from the slots 83, one need merely press inwardly on the tongue portions 94 of the respective tabs 81, and then with the same motion push downwardly in order to bring the tongue portions 94 within the slot 83. At this point, there is no further interference mechanical interference retaining the frame 61 in place, and the wearer may simply grasp the face mask and pivot it outwardly and upwardly about the axis of the wire 36. The outer or sideward surface of the tongue portion 94 is horizontally ribbed, as seen at 101 in FIG. 4, in order to facilitate the downward push which initiates release of the face mask.

While a specific embodiment of this invention has been illustrated in the attached drawings and described in the foregoing disclosure, it will be evident to those skilled in the art that changes and modifications may be made therein, without departing from the essence of this invention as set forth in the accompanying claims.

I claim:

1. A clip for joining a first member to a second, the first member having an elongate element supported between resilient spaced apart brackets defining slots into which said elongate element can snap to extend therebetween the second member having a recess in the form of an elongate slot, the clip comprising two similar halves integrally pivoted together and defining adjacent the pivot region a receiving cavity for the elongate element, each half having resilient means adapted to co-act with the recess to be retained by and in the recess, the resilient means comprising the bifurcation of each half to define two resilient tines, with each tine having an external step projecting away from the other tine, each tine being adapted to engage a shoulder region of the recess, whereby to retain the clip within the recess.

2. The clip of claim 1 wherein the second member is in the form of a helmet and the first member is in the form of a face mask for the helmet, the elongate element being a wire constituting the upper forward portion of a wire grid, the first member also including a frame with frame portions adjacent at least part of the periphery of the wire grid, one of said frame portions integrally supporting said resilient, space-apart brackets whereby said clip can encircle the wire between the brackets with said bifurcated halves entering said elongate slot, thereby securing both the frame and the wire grid to the helmet in such a manner that both the frame and the grid can pivot about the wire axis with respect to the helmet.

3. The combination claimed in claim 2, in which adjustment means are provided between the grid and the frame at a location remote from said wire axis, whereby the grid can assume and be fixed in any one of a plurality of angulated positions with respect to the frame.

4. The combination claimed in claim 3, in which said adjustment means includes a chin guard element at a part of the periphery of the grid which is remote from said wire, the chin-guard element having side portions which overlap the frame on the outside thereof and have an irregular structure for registering with complementary structure on the frame.

5. The combination claimed in claim 4, in which said irregular structure comprises a plurality of openings aligned along an arc with its center of curvature at said wire axis, said complementary structure comprising at least one protuberance adapted to register in different ones of said plurality of openings.

6. The combination claimed in claim 4, in which said frame has two portions remote from said brackets for releasable engagement with said helmet, thereby to retain said frame in a given position with respect to said helmet.

7. An adjustable face mask for a helmet, the face mask comprising a wire grid and a frame surrounding the wire grid, the frame including top and side portions formed integrally with each other and disposed generally adjacent top and side portions of the wire grid, the top portion of the wire grid being pivoted to the top portion of the frame, an independent bottom portion of the frame being shaped to protect the wearer's chin and being secured to the bottom portion of the wire grid, adjustment means between the bottom portion of the frame and the side portions of the frame, by which the angular position of the wire grid with respect to the top and side portions of the frame can be selectively adjusted, said adjustment means including an overlap between the bottom and side portions of the frame, the bottom portion of the frame having irregular structure for registering with complementary structure on the side portions of the frame.

* * * * *